US007017614B2

(12) United States Patent
Handley

(10) Patent No.: US 7,017,614 B2
(45) Date of Patent: Mar. 28, 2006

(54) DOWNSPOUT EXTENSION

(75) Inventor: Stephen Handley, Barrie (CA)

(73) Assignee: GSW Inc., Oakville ( * ) Notice: Subject to any disclaimer, the term of this patent is extended or adjusted under 35 U.S.C. 154(b) by 29 days.

(21) Appl. No.: 10/759,036

(22) Filed: Jan. 20, 2004

(65) Prior Publication Data

US 2005/0155660 A1 Jul. 21, 2005

(51) Int. Cl.
*F16L 11/11* (2006.01)

(52) U.S. Cl. ..... 138/109; 138/118; 138/119; 138/121; 285/226; 285/903; 52/14

(58) Field of Classification Search ..... 138/118, 138/109, 121, 119, DIG. 8, DIG. 11, 177; 285/226, 236, 237, 903; 52/16
See application file for complete search history.

(56) References Cited

U.S. PATENT DOCUMENTS 3,076,669 A * 2/1963 Schlein ..... 285/179
3,349,805 A * 10/1967 Fried ..... 138/109
3,825,288 A * 7/1974 Maroschak ..... 285/133.6
4,953,897 A * 9/1990 Klober ..... 285/226
5,813,701 A * 9/1998 Noble ..... 285/4
5,915,735 A * 6/1999 Noble ..... 285/4
6,041,825 A * 3/2000 Smith et al. ..... 138/109
6,223,777 B1 * 5/2001 Smith et al. ..... 138/109

* cited by examiner

*Primary Examiner*—Patrick Brinson

(57) ABSTRACT

A repositionable downspout extension is formed as an integral blow molded plastic component having three distinct sections. A downspout connector end merges with a corrugated extendible middle section which terminates in a drainage pipe connector. The downspout connector includes two rectangular sections of different sizes defining two different securing segments for engaging two different sizes of downspouts. The middle section is of a pleated configuration and is of variable length by expanding or collapsing of the pleats. The drainage pipe connector is a circular connector for connecting with commonly used corrugated plastic pipe or rigid plastic pipe. In a preferred embodiment the downspout connector end also includes a connector for insertion and retention in the corrugated middle section.

12 Claims, 8 Drawing Sheets

DOWNSPOUT EXTENSION

FIELD OF THE INVENTION

The present application relates to downspout extensions, and in particular, to a downspout extension which is repositionable and easily connects with drainage pipes.

BACKGROUND OF THE INVENTION

Eavestrough systems work effectively in directing water from a roof to a particular downspout and subsequently discharging the water at a point spaced a certain distance from the house or structure. A number of different products are available for connection with the lower edge of a downspout for directing and discharging the water. It is recommended and often essential that the water be discharged at least three to four feet from a foundation wall to avoid problems associated with the water flowing back to the foundation wall and leaking interior to the structure or causing other foundation problems.

Existing products include hingeable downspout extensions which are connected to the lower part of a downspout and are movable between an upright position, that allows the homeowner to temporarily move the structure for cutting of grass, to an extended position where the water is discharged a number of feet from the house. Another approach is to use a splash block provided on the ground. These splash blocks are typically prefabricated plastic or concrete structures designed to receive the discharge of a downspout or elbow and move the water to the edge of the splash block. The splash block is also designed to slow the discharge of the water whereby erosion at the edge of the splash block is avoided or reduced.

It is also known to use buried drainage pipe for directing the water often a longer distance to a suitable discharge point such as a ditch or other low location. Such underground systems typically use rigid plastic pipe or flexible corrugated pipe. These products are designed to be buried and to withstand certain loads without collapsing.

It is also known to use a flexible extendible downspout diverter having a corrugated or pleated central section which allows adjustment of the length of the diverter. The downspout diverter has a rectangular connector at one end thereof for connecting with a downspout of a common size and a rectangular connection at the other end for connecting with a different size of downspout. This product is offered by GUTTER WORLD. In addition to the two different sizes of rectangular connectors, other specialized cross sections are provided for connecting of the product to itself and connecting with other products. This known diverter is shown in U.S. Pat. Nos. 6,223,777; 6,041,825; 5,915,735 and 5,813,701.

The present invention provides an extendible downspout extension designed to cooperate with different types of standard rectangular downspouts presently being used and also to cooperate with existing underground drainage systems. The product is intuitive and allows simple connection without cutting or allows the end purchaser to cut off a redundant downspout connector for a more precise finish. In addition, the product is such that it is readily understood with respect to the various possible applications of the product to extend the discharge system by adding a further downspout extension or connecting with a standard underground drainage system.

SUMMARY OF THE INVENTION

A repositionable downspout extension according to the present invention comprises an integral, extruded plastic component having a downspout connector end and a corrugated middle section of extendable length and a drainage pipe connector end. The downspout connector end includes a large generally rectangular connector for connecting with a downspout of a first known size which merges with a smaller generally rectangular connector for connecting with a downspout of a second known size, smaller than the first known size. The corrugated middle section is generally rectangular in section and has a series of expandable pleats movable between a collapsed position of a short length to an expanded position of a length much greater than the short length. The pleats allow the downspout extension to be easily bent for changes in direction or repositioning. The drainage pipe connector end comprises a circular collar which on one side thereof merges with the corrugated middle section and is open on an opposite side. The collar is of a width to allow effective connection with a drainage pipe.

According to an aspect of the invention the repositionable downspout extension has on the downspout connector end, a corrugation connector sized for an interference connection with the corrugated middle section.

In yet a further aspect of the invention, the corrugation connector is of a rectangular cross section and includes a projecting locking arrangement which extends outwardly from the corrugation connector defining an interference fit when inserted in a corrugated middle section of a second downspout extension.

In yet a further aspect of the invention, the corrugation connector is of rectangular cross section and includes locking recesses which cooperate to engage an interior edge of the pleats when the corrugation connector is inserted in the middle section of a further downspout extension.

In yet a further aspect of the invention, the locking arrangement is continuous about the periphery of the corrugation connector.

In yet a further aspect of the invention, the drainage pipe connector end includes guiding instructions molded therein for removing of the drainage pipe connector.

In yet a further aspect of the invention, the drainage pipe connector end and the downspout connector end each include guide instructions molded therein for removing of the respective connector end.

In a further aspect of the invention, the downspout connector end includes two guide instructions molded therein, namely one guide instructions for removing said large rectangular connector and one guide instruction for removing said large rectangular connector and the small rectangular connector.

In yet a further aspect of the invention, the large rectangular connector and the small rectangular connector each include inwardly directed protrusions on their sides for defining an interference contact with a downspout.

In yet a further aspect of the invention, the drainage pipe connector includes a series of inwardly extending protrusions spaced about the collar for interference fit with a drainage pipe.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
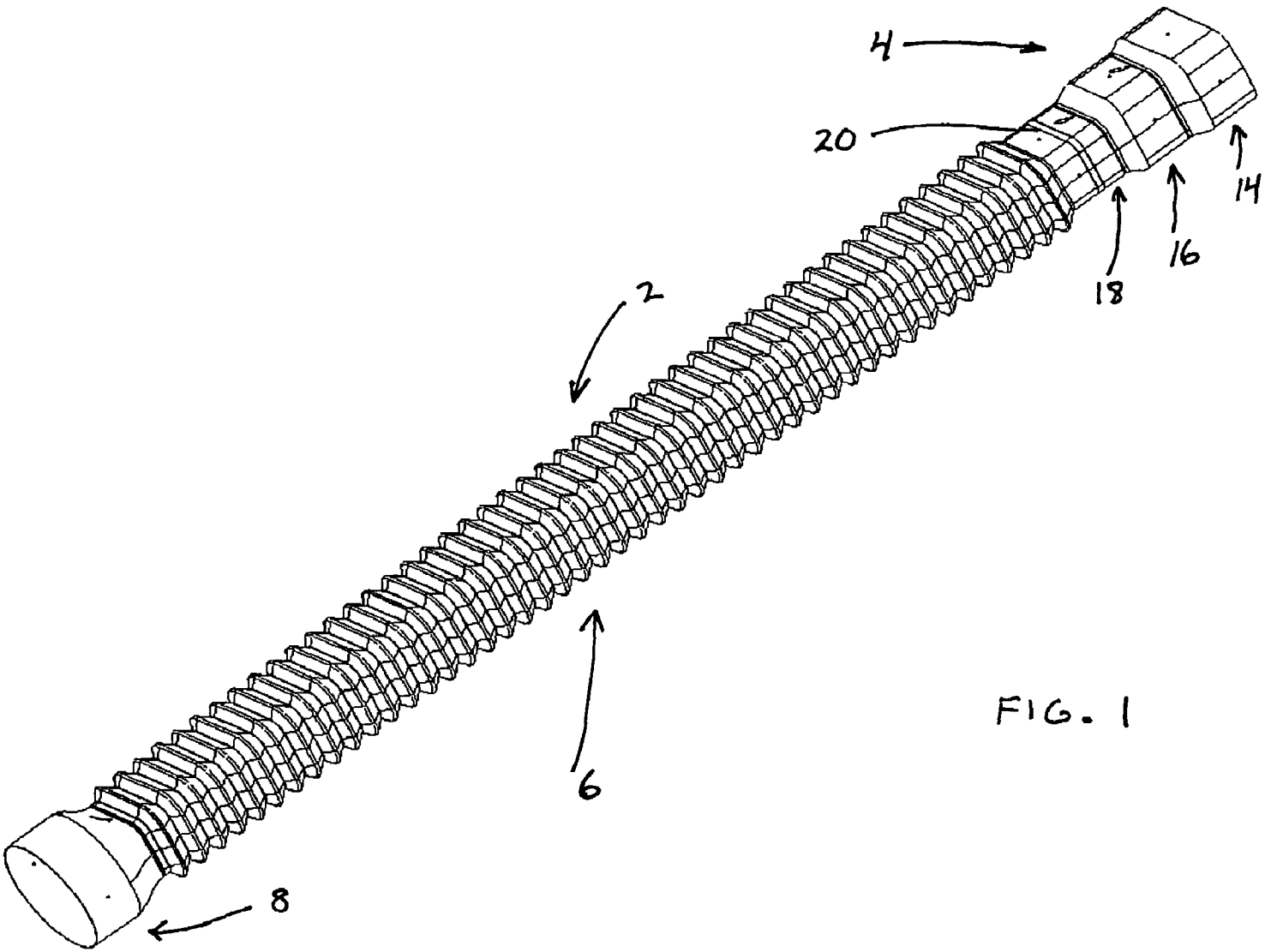
FIG. 1 is a perspective view of the repositionable downspout extension.

The repositonable downspout extension 2 as shown in the drawings has a downspout connector end 4, an expandable corrugated or pleated middle section 6, and a drainage pipe connector end 8. The product is of a plastic material and is typically manufactured by a blow molding process, a corrugated extrusion process or other appropriate molding process.

Eavestroughing and downspouts are most commonly made of a plastic or aluminum material and are available in different sizes. The most common downspout sizes are a three by four rectangular in cross section downspout, a three by three generally rectangular in cross section downspout, and a two by three rectangular in cross section downspout. As can be appreciated, the corners of the rectangular sections are curved to provide a more pleasing eye appeal. The present repositionable downspout extension is adapted for connection with either of these standard downspout sizes. The large rectangular connector 14 is used for the larger size whereas the smaller rectangular connector 16 is used for a smaller size. As can be appreciated, from a review of the perspective view of FIG. 1, it is not necessary for the end user to remove the large rectangular connector 14 if the smaller rectangular connector 16 is required. This larger size can merely be left on the downspout extension as it is larger than the downspout which can pass through the large connector and connect with the smaller rectangular connector therebelow. For a more precise finish, the large connector 20 can be cut off as will be more fully described.

Located between the corrugated middle section 6 and the smaller rectangular connector 16, is a corrugation/rectangular connector 18. The corrugation/rectangular connector includes an outwardly projecting locking rib 20. This locking rib provides an interference fit when the connector is inserted in the corrugated middle section of a second downspout extension (see FIG. 7). It is preferred that the locking rib be continuous, however, it is also possible to have a series of projections extending outwardly from the corrugation connector which would also serve to provide the necessary interference fit. The corrugation/rectangular connector 18 is also used to join with a smaller or third size of rectangular in cross section downspout.

Figure 2:
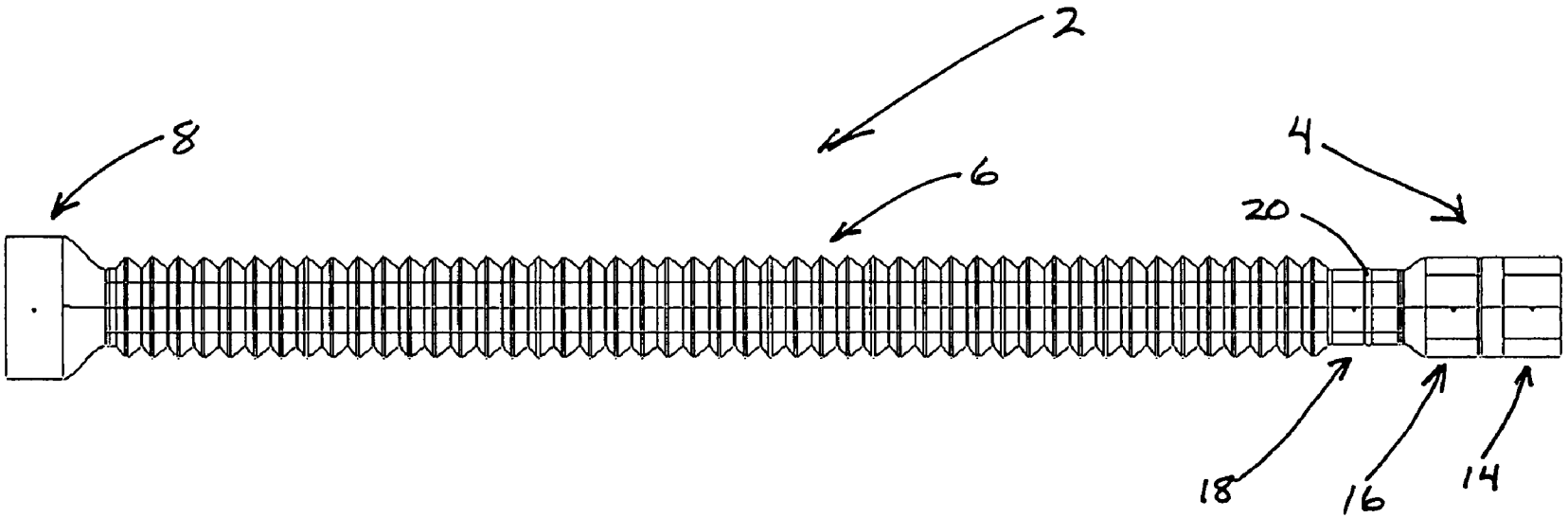
FIG. 2 is an expanded side view of the downspout extension.
Figure 3:
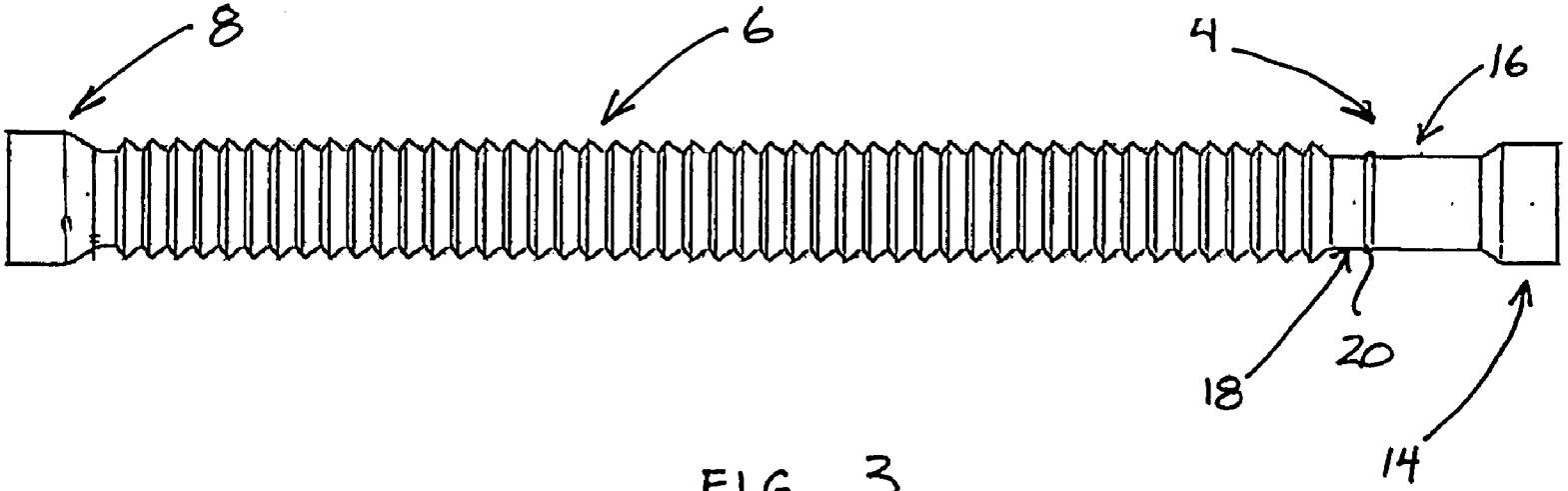
FIG. 3 is a top view of the downspout extension.

The corrugated middle section 6 has a series of pleats which are effectively collapsible upon themselves. Each pleat includes two walls which are joined by a hinged connection. In the collapsed configuration, these walls are abutting or in close proximity to one another and are generally parallel. In the extended position as shown in FIGS. 1, 2 and 3, the pleats are separated from one another to define a greater length of the downspout extension. These locking pleats basically go through an over center position (similar to a spring biased over center latch) and prefer to be either in an extended position or a collapsed position. This also allows for changing the position of the downspout position to allow curving of the middle section for repositioning around objects such as trees and bushes. These lockable corrugated pleats have been used for many years in association with children's toys as well as plumbing fixtures, such as a tail pipe extension, where the locking and repositioning aspects of the pleats are used to join pipes which are not aligned.

Figure 4:
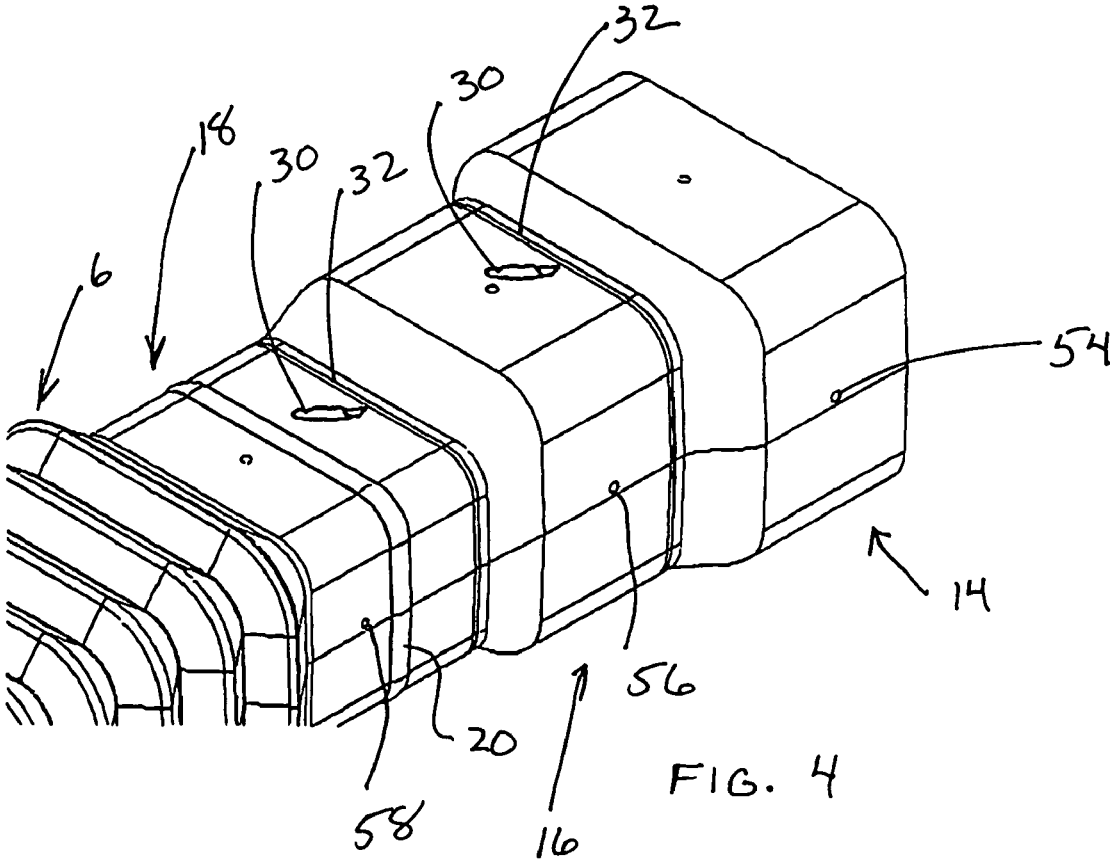
FIG. 4 is a partial perspective view showing the downspout connector and of the extension.

FIG. 4 shows additional details of the downspout connector end 4. As can be seen, the large rectangular connector 14 (for fitting with a three by four inch downspout) also includes on at least two walls, if not four walls of the connector, inwardly directed protrusions 54. These protrusions serve to improve the fit and retention of the large rectangular connector 14 when it is forced over the appropriate size of downspout. In addition, these protrusions can be used as a screw location positions in mechanically connecting the connector to a downspout. Similar projections 56 are provided for the smaller rectangular connector 16 (three by three inch downspout). In addition, the corrugation/rectangular connector 18 also includes an inwardly directed projection 58 for mechanically securing the connector 18 with a third size of downspout (two by three inch). These inward protrusions compensate for relatively high tolerance variations associated with blow molding manufacturing and ensure contact with a downspout. It is apparent other sizes of connectors can be used.

The downspout of FIG. 4 also includes guide instructions 30 and cut line 32 to inform the user as to the location and manner of removing of one or both of the rectangular connectors 14 and 16. Basically, a razor knife depiction is used in combination with the engraved cut line 32 for removing of these connectors. Thus, the product itself provides instructions to the user regarding its intended use.

Figure 5:
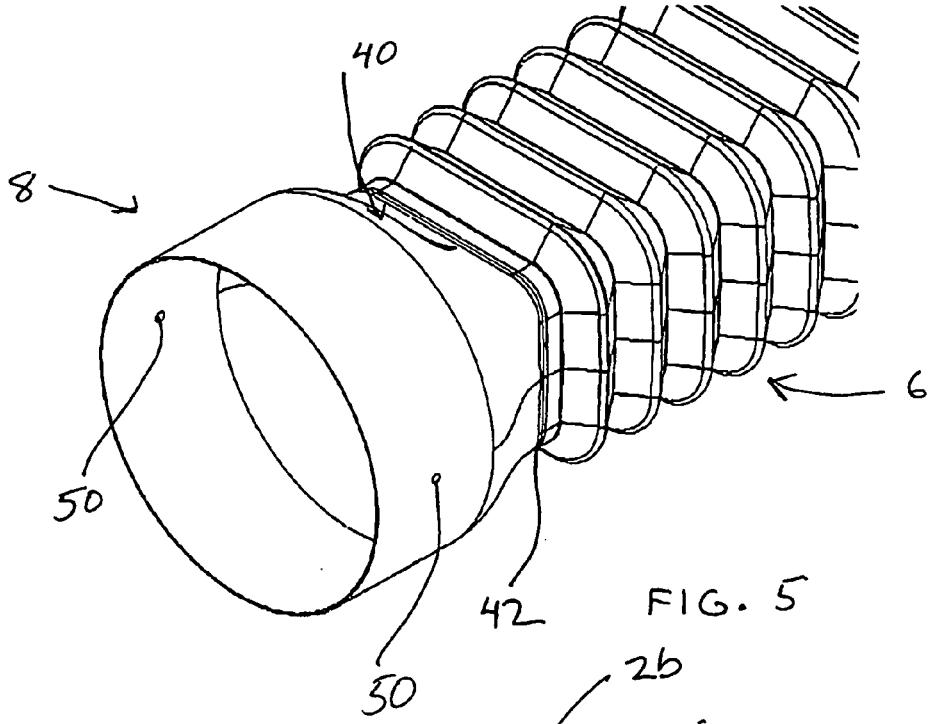
FIG. 5 is a partial perspective view showing the drainage pipe connector.
Figure 6:
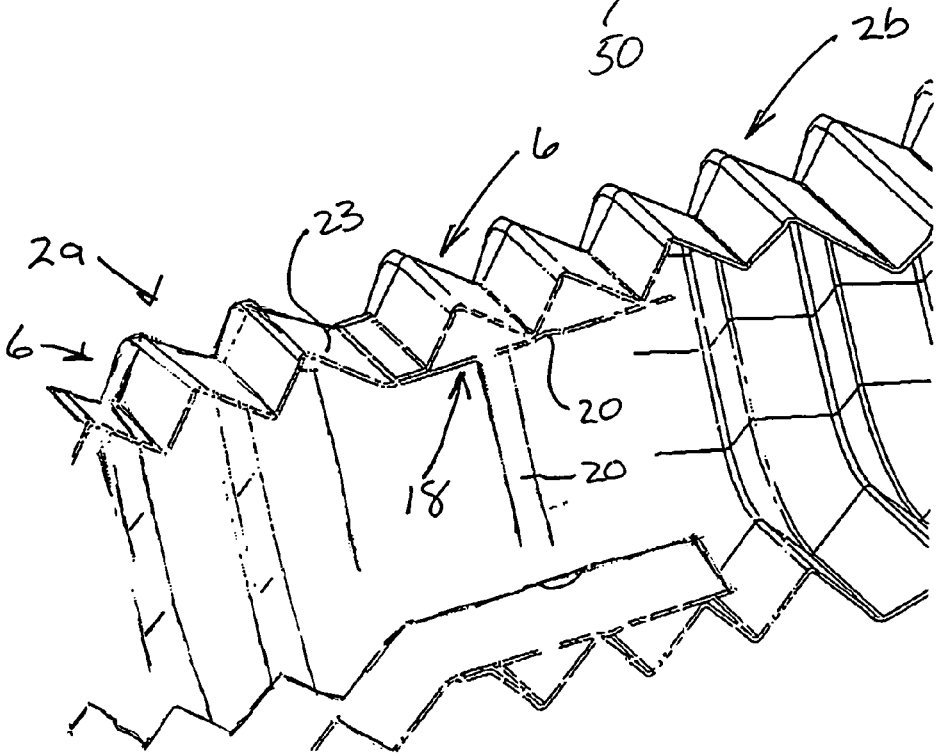
FIG. 6 is a partial cutaway perspective view showing two downspout extensions being connected one to the other.

FIG. 5 is a partial perspective view of the drainage pipe connector end. Guide instructions 40 are molded into the product in the form of a razor knife in combination with the cut line 42. Should the user wish to remove the drainage pipe connector 8, he merely uses a razor knife in combination with the cut line to remove the connector at the indicated position. This engraved cut line also acts as a guide. The end user would use to corrugation/rectangular connector 18 to join two downspout extensions to one another without using the drainage pipe connector. The drainage pipe connector of the first downspout exterior is removed and the rectangular connectors of the second downspout extension are removed by cutting at the second cut line to expose or make available the corrugation connector. The exposed corrugation/rectangular connector 18 is then forced into the corrugations of the first extension. Such a connection is shown in the partial cutaway view of FIG. 6. As shown, the corrugation/rectangular connector 18 has been forced into the middle section 6 of another downspout extension and at least one pleat of the middle section is retained between the locking rib 20 and the first corrugation locking pleat 23 of the second downspout extension. As clearly shown in the drawings, the locking rib cooperates with the pleat on the inner periphery of the pleat and provides an effective connection therewith. The generally flat sidewalls of the rectangular cross section of pleated section can have a tendency to sink or deform inwardly if the product is released from the mold before the plastic has cooled sufficiently. Any inward deformation merely improves the interference connection.

Figure 7:
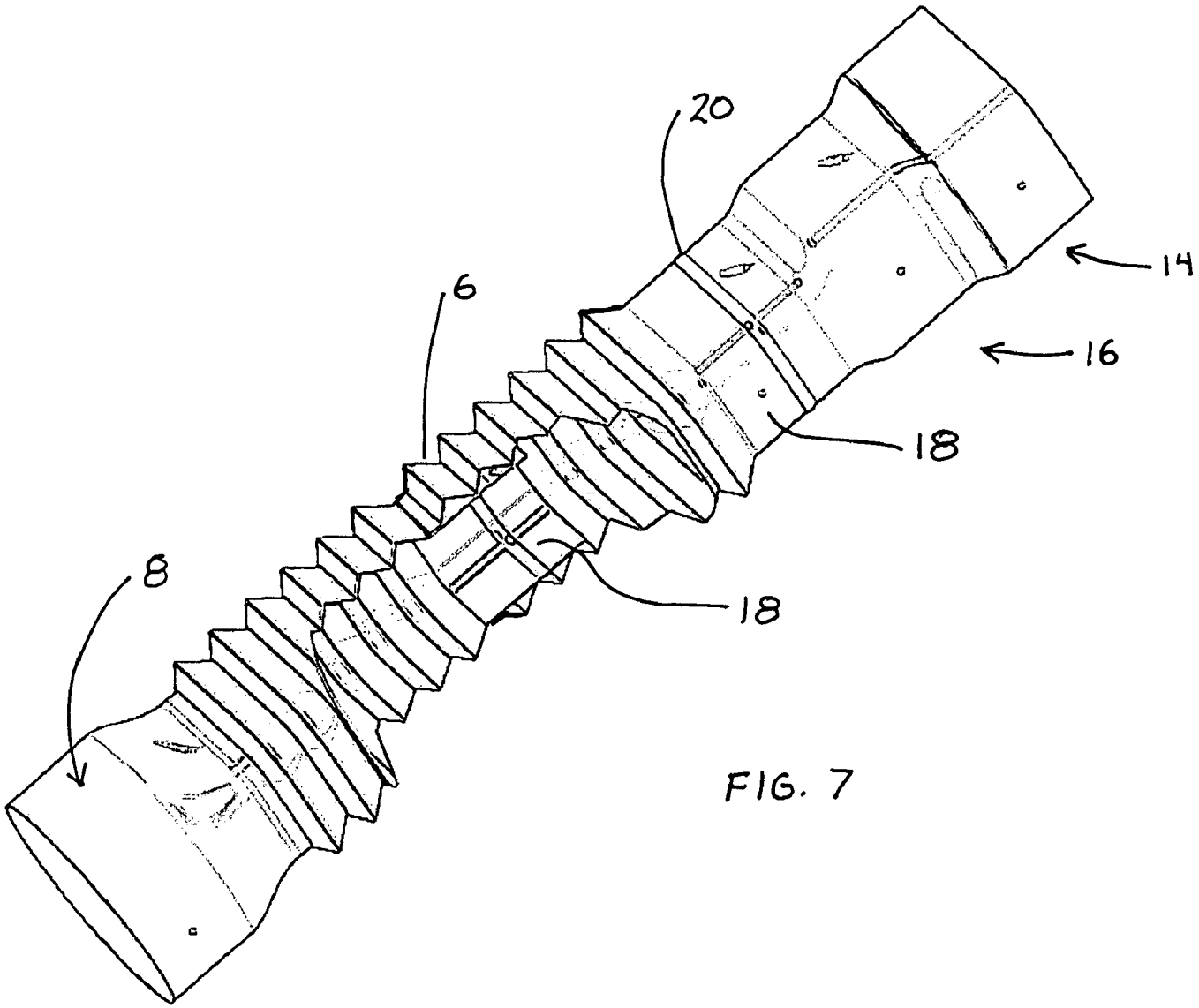
FIG. 7 is a view similar to FIG. 6 showing such a connection and also showing the two products.

FIG. 7 is a partial cutaway where two extensions have been joined one to the other. For illustrating purposes they are shown of reduced length. Each of these products would be substantially longer in normal use. As shown in FIG. 7, the corrugation/rectangular connector 18 of the one downspout extension 2*a* has been inserted within the corrugated middle section 6 of the second downspout extension 2*b*. The drainage pipe connector of the second downspout extension 2*b* has been removed. The drainage pipe connector of the extension 2*b* could have been left in place but has been removed to provide a cleaner appearance. In some applications, it may be desirable to leave the drainage pipe connector of the extension 2*b* in place to provide additional protection for the connection. For example, it may be preferable in buried applications to leave the connector in place. The corrugation/rectangular connector 18 can easily be forced through the larger drainage pipe connector 8 for locking the middle portion.

Figure 8:
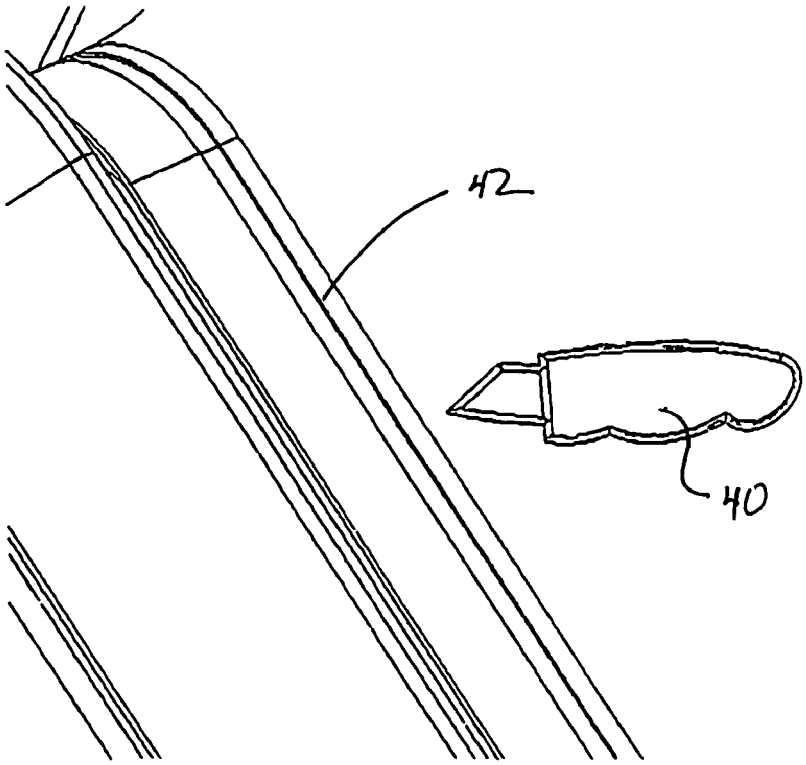
FIG. 8 is a partial view showing guiding instructions molded into the product for the end user.

FIG. 8 shows additional details of the guide instruction 40 in the form of a razor knife positioned in close proximity to the engraved cut line 42. These instructions provide a simple arrangement for informing the user of the appropriate cut locations and providing a cut guide.

Figure 9:
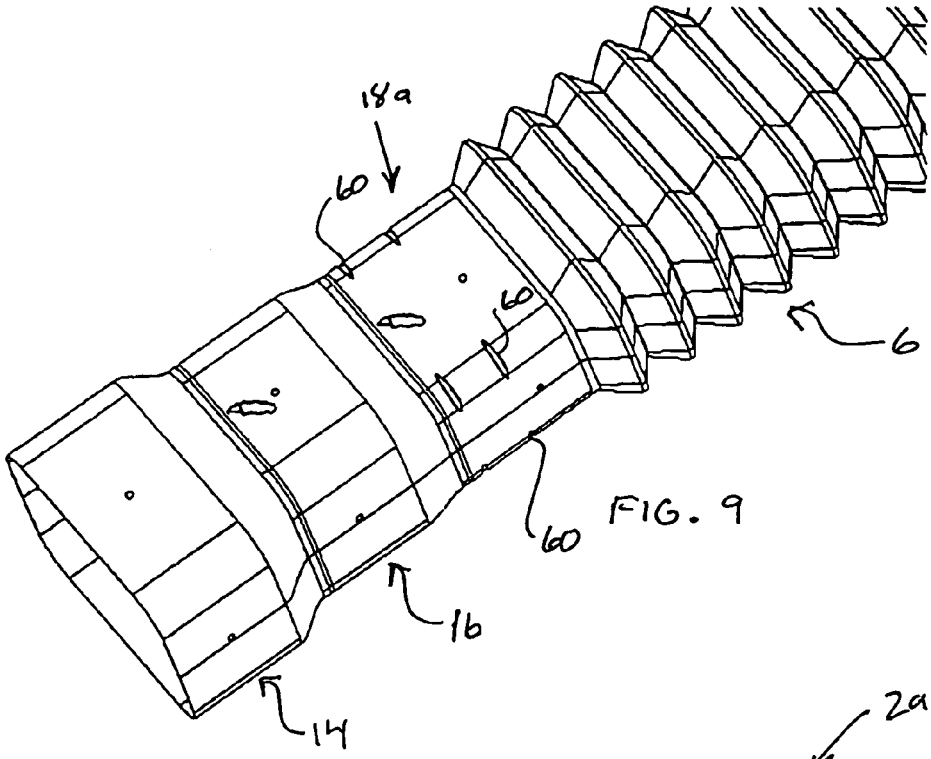
FIG. 9 is a partial perspective view of the downspout connector and showing an alternate arrangement for connecting of two such extensions and also showing clear guidance of the cutting of the connector.
Figure 10:
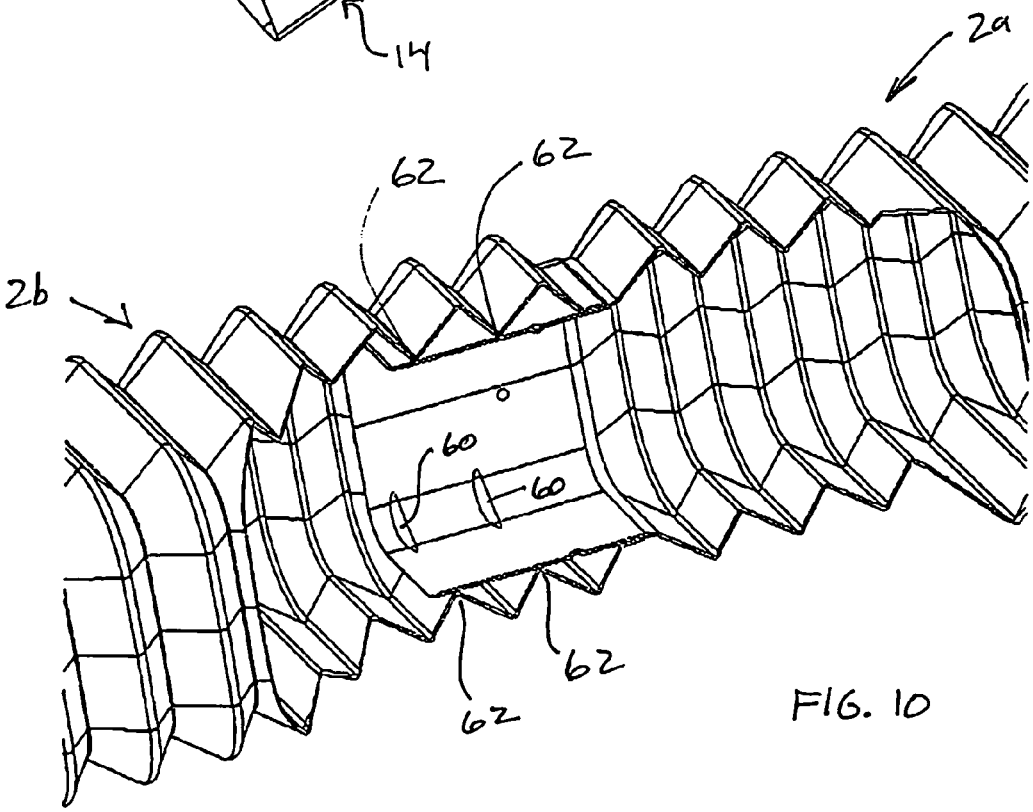
FIG. 10 is a partial perspective view showing two extensions joined using the alternate construction of FIG. 9.

An alternate corrugation connector is shown in FIG. 9. In this case, the corrugation connector includes on each of its corner, inwardly directing channels 60. These channels 60 cooperate with the interior hinge points 62 of the pleats as shown in FIG. 10. Thus the inward hinged points 62 of the pleats interlock or provide an overlapping fit with the corrugation/rectangular connector 18*a* as shown in FIG. 9. The inward projections 60 are provided on the corners as the corrugations tend to be stiffer at the corners and the fit is more precise. By providing two such locking arrangements on each corner of the corrugation/rectangular connector 18, strong securement is achieved.

With the product as shown in the drawings, a user need not remove any of the components if he does not wish to do so or the circumstances dictate a fast response. For example, the product can be connected to the larger standard four by three downspout extension using the large connector 14. If the downspout is a two by three connector, the user merely forces the extension somewhat further on to the downspout and uses the smaller connector located therebelow. This smaller connector can then be mechanically fastened or otherwise secured to the downspout. Often problems associated with the discharge of water from eavestroughs is not realized until there is a problem such as during a rainstorm or extended period of rain. The ability to quickly use the downspout extension without cutting is desirable. The final precise solution can be completed when the weather permits.

If two such downspout extensions are to be joined one to the other, it is not necessary to use the corrugation/rectangular connector 18. For example, the first downspout extension could be connected to a downspout and the drainage pipe connector can be forced over the drainage pipe connector of the second extension. The downspout extensions are preferably blow molded plastic products with relatively thin walls. It is possible to insert one drainage pipe connector within the other connector as some distortion of the connectors occurs. The inward protrusions on the drainage pipe connectors can be used to provide a lock fit, one with the other.

It has been found that this particular product is useful for repositioning of the downspout extension and accommodating different length requirements. Although the product has been described where two products are connected one to the other, it would be more common and practical to connect the downspout extension to an underground drainage system. This application typically uses a buried corrugated plastic pipe which allows bending but does not allow elongation, or a rigid plastic pipe. In either case, the drainage pipe connector 18 can be mechanically fastened to the drainage system with a suitable overlap.

With the present product the rectangular shape of the known downspout systems is maintained in both the downspout connector end and the middle section. The drainage pipe connector can be removed if it is not required. In this may the downspout extension is more consistent with the eavestrough system and less obtrusive.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A repositionable downspout extension comprising an integral plastic component having a downspout connector end, a corrugated middle section of extendable length, and a drainage pipe connector end; said downspout connector end including a large generally rectangular connector for connecting with a downspout of a first known size which merges with a smaller generally rectangular connector for connecting with a downspout of a second known size smaller than said first known size; said corrugated middle section being generally of a rectangular section having a series of expandable pleats movable between a collapsed position of a short length through a center position to an expanded position of a length much greater than said short length, said pleats allowing said downspout extension to be easily bent for changes in direction or repositioning; said drainage pipe connector end comprising a circular collar which on one side thereof tapers inwardly and merges with said corrugated middle section and is open on an opposite side, said collar being of a width to allow effective connection with a drainage pipe.

2. A repositionable downspout extension as claimed in claim 1 wherein said downspout connector end includes a corrugation connector sized for connection with said corrugated middle section.

3. A repositionable downspout extension as claimed in claim 2 wherein said corrugation connector is of rectangular cross section and includes a projecting locking arrangement which extends outwardly from said corrugation connector for an interference fit if inserted in said corrugated middle section.

4. A repositionable downspout extension as claimed in claim 3 wherein said locking arrangement is continuous about the periphery of said corrugation connector.

5. A repositionable downspout extension as claimed in claim 3 wherein said drainage pipe connector end includes guiding instructions molded therein for removing of said drainage pipe connector.

6. A repositionable downspout extension as claimed in claim 3 wherein said drainage pipe connector end and said downspout connector end each include guide instructions molded therein for removing of the respective connector end.

7. A repositionable downspout extension as claimed in claim 6 wherein said downspout connector end includes two guide instructions molded therein namely one guide instructions for removing said large rectangular connector and one guide instruction for removing both said large rectangular connector and said smaller rectangular connector.

8. A repositionable downspout extension as claimed in claim 3 wherein said large rectangular connector and said smaller rectangular connector each include inwardly directed protrusions on the sides thereof for interference contact with a downspout.

9. A repositionable downspout extension as claimed in claim 3 wherein said drainage pipe connector end includes a series of inwardly extending protrusions spaced about said collar for interference fit with a drainage pipe.

10. A repositionable downspout extension as claimed in claim 2 wherein said corrugation connector includes locking recesses for cooperating and locking with an inward edge of the pleats of said middle section of a second downspout extension when inserted therein.

11. A respositionable downspout extension as claimed in claim 2 wherein said downspout connector end includes a further rectangular connector of a third known size.

12. A repositionable downspout extension as claimed in claim 11 wherein said rectangular connectors are for connecting wit downspout sizes of about three inches by four inches, three inches by three inches, and two and one half inches by three inches.

* * * * *